US007549558B2

(12) United States Patent
Weist

(10) Patent No.: US 7,549,558 B2
(45) Date of Patent: Jun. 23, 2009

(54) POURING SPOUT CLOSURE WITH A PIERCING CUTTER FOR COMPOSITE PACKAGINGS OR CONTAINERS SEALED WITH FILM MATERIAL

(75) Inventor: Mario Weist, Stuhlingen (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 373 days.

(21) Appl. No.: 10/566,005

(22) PCT Filed: Jul. 14, 2004

(86) PCT No.: PCT/CH2004/000449

§ 371 (c)(1),
(2), (4) Date: Mar. 20, 2006

(87) PCT Pub. No.: WO2005/009847

PCT Pub. Date: Feb. 3, 2005

(65) Prior Publication Data

US 2006/0163281 A1 Jul. 27, 2006

(30) Foreign Application Priority Data

Jul. 28, 2003 (CH) ..... 1311/03

(51) Int. Cl.
*B67D 5/00* (2006.01)

(52) U.S. Cl. ..... 222/83; 222/541.2; 220/267

(58) Field of Classification Search ..... 222/83, 222/83.5, 86, 533, 534, 566–570, 541.2; 229/216, 123.1, 123.2, 123.3, 200, 204, 125.04, 229/125.08; 220/258.4, 260, 263, 267, 277, 220/278; 383/200, 42, 47, 80
See application file for complete search history.

(56) References Cited

U.S. PATENT DOCUMENTS 4,930,683 A * 6/1990 Farber ..... 229/125.09
5,875,959 A * 3/1999 Weiteder et al. ..... 229/125.15
5,947,316 A * 9/1999 Guillonnet ..... 220/269

(Continued)

FOREIGN PATENT DOCUMENTS

WO WO 98/33714 * 8/1998 ..... 222/566

(Continued)

*Primary Examiner*—Lien T Ngo
(74) *Attorney, Agent, or Firm*—Edwin D. Schindler

(57) ABSTRACT

A pouring closure includes a flange for welding onto a combipack or to the foil material of a container sealed with the foil material, along with an upwardly projecting circular rim thereon and a rotatable combined lid and pouring nozzle that can be clipped onto the upwardly projecting circular rim, which forms a piercing edge arrangement. This piercing edge arrangement includes a part of a cap lid, which can be opened from the lid surface around a swinging axis. Two piercing cutters are on the lower side of this part of the cap lid behind its swinging axis and near the edge of the cap rim and are able to be folded up beyond a level of the lower side of the flange and to pierce the combipack or the membrane liner running below the flange. Thereafter, the lid and pouring nozzle is rotated on the flange rim, so that the two piercing cutters cut-out a disc, of approximately 360°, from the combipack or the membrane liner after the folding upwards movement.

13 Claims, 7 Drawing Sheets

U.S. PATENT DOCUMENTS

Figure 1:
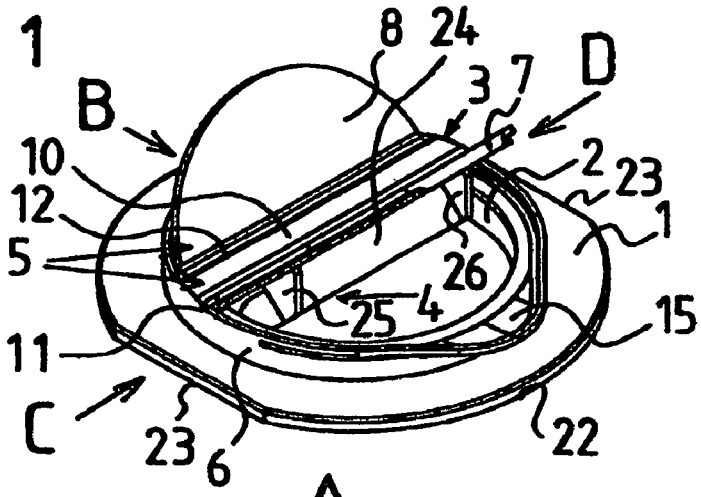

| | | | | |
|---|---|---|---|---|
| 6,041,968 | A * | 3/2000 | Weiteder | 222/83 |
| 6,257,449 | B1 | 7/2001 | Baerenwald | |
| 6,685,055 | B2 * | 2/2004 | Taylor | 222/83 |
| 7,152,767 | B2 * | 12/2006 | Seelhofer | 222/536 |

FOREIGN PATENT DOCUMENTS

| | | | | |
|---|---|---|---|---|
| WO | WO 00/75034 A1 | 12/2000 | | |
| WO | WO 02/40360 | * | 5/2002 | 222/566 |

* cited by examiner

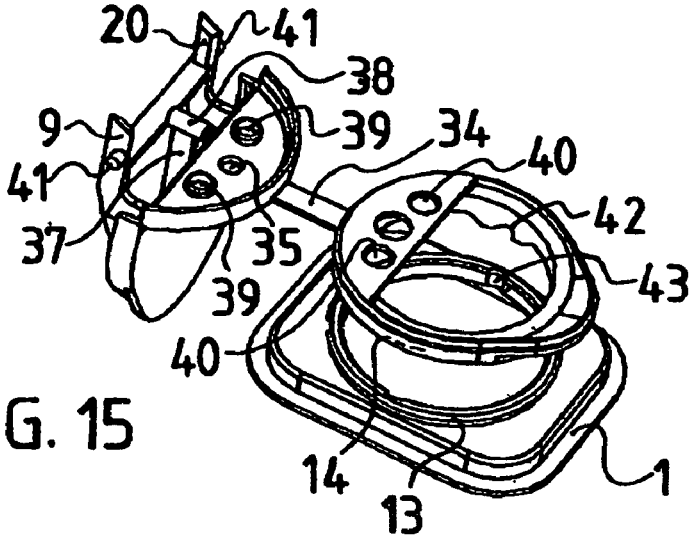
FIG. 15
FIG. 16
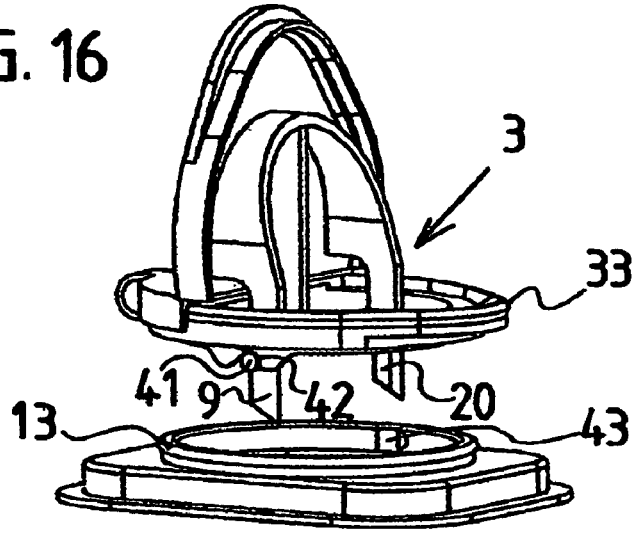
FIG. 17
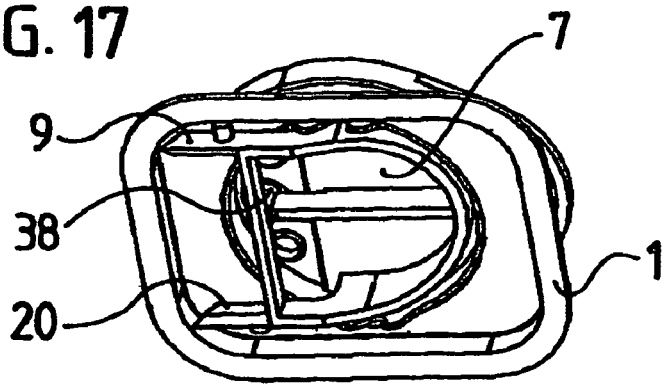

POURING SPOUT CLOSURE WITH A PIERCING CUTTER FOR COMPOSITE PACKAGINGS OR CONTAINERS SEALED WITH FILM MATERIAL

BACKGROUND OF THE INVENTION

1. Technical Field of the Invention

This invention concerns a pouring closure for combipacks as well as containers sealed with foil material of all types, which includes a piercing edge arrangement. Moreover, liquid packings in the form of such combipacks out of foil-laminated paper are particularly considered, in which for example milk, fruit drinks, variety of drinks or general liquids, even out of non-food range, are packed. But the closure can be used also for combipacks, in which bulk materials like for example sugar, semolina, rice or a variety of chemicals and similar materials are kept or packed. In case of paper, it is a question of a laminated material, perhaps a paper or cardboard web coated with plastic, like for example polyethylene, and/or aluminium. Usual volumes of such packings extend from 20 cl up to 2 liters and more. Alternatively, the pouring closure can also be assembled on containers, which are sealed by a foil material, for example on a variety of bottles out of glass or plastic or on similar containers.

2. Description of the Prior Art

Such closures out of plastic are available in different embodiments. They form, if they are determined for a combipack, essentially a pouring edge or pouring nozzle with a shoulder projecting radially out from its bottom edge, which forms a closing flange at this edge or nozzle. In case of a nozzle, this is mostly equipped with an external thread, on which a threaded cap can be screwed as closure. In case of a bottle closure, the nozzle can be fixed or screwed on a bottle mouth. Other pouring closures have a lid which is hinged via an internal hinge that can be opened. Such a pouring closure is flanged on the combipack, in which it is welded leak-proof on the combipack with the bottom side of its projecting edge, that is with the bottom side of its flange. The free passage at the bottom end of the edge or nozzle is thereafter sealed by the paper and the membrane liner of the combipack.

The foil-reinforced paper going through below the cut-open nozzle or pouring closure or the foil membrane running below the nozzle or closure must be cut, torn open or pressed out for opening, so that the passage is made free and the liquid or the bulk material can be poured out or emptied out from the container through the nozzle or the pouring closure. In addition to this, a sleeve is arranged within the nozzle, which is carried along by the threaded cap during its turning and therefore is turned in the same rotating direction by it. This moves downwards steadily with the screwing out through a thread on the inner side of the nozzle and the outer side of the sleeve running counter to the thread on the outer side of the nozzle and the inner side of the cap, that is if this is moved upwards against the fluid packing. The lower edge of the sleeve is provided with one or more tearing or cutting teeth. The sleeve shall press out or cut out a disc from the foil-reinforced paper or the foil membrane running through below it as a result of its rotating and steady downward motion.

Usually, however, such self-opening closures do not always function fully satisfactorily. The discs are not cut out clean from the paper foil or the foil membrane, but on the contrary these sleeves simply press out a piece of foil from it. The remaining edge is frayed out and consequently projects paper or foil shreds into the passage, which should be removed properly. These shreds project often even below in the container and possibly block the path for the air to be taken in into the container from outside during the pouring or emptying out or they project fully in the way of the stream flowing out or the materials being emptied out. In case of large packings with strong foil-reinforced paper or cardboard, the opening is carried out even less reliably and cleanly. The sleeve moving downward slowly and rotating simultaneously touches the foil-reinforced web to be cut with its entire bottom edge and completely presses it towards the bottom and rotates on it until a hole is scraped through or broken through and then cut. A problem as to why the cutting is messy lies among others in the fact that the foil to be cut yields to the pressure of the sleeve, working to a certain extent as boring head, somewhat downwards and consequently the sleeve no longer acts on a plane of paper foil but on foil bulged downwards. Further, the solutions until now require a suitable force from the side of the user because of the form of the sleeves, which are designated analogously also as punch, since they break through simply one more paper-foil piece in order to cut out a circular disc cleanly. That is, a large torque must be applied since the teeth or the ripper on the lower punch edge or sleeve edge have to at first scratch the foil distributed around the entire circumference clean and afterwards overcome a large rotational resistance. They act in the top-most layer of the paper thickness similar to tearing teeth, that is, scraping, pressing and tearing, instead of acting as real cutting blades with sharp cutting edges.

In order to simplify the breaking out or tearing out, the foil material or the composite material is pre-weakened by means of lasers or punches at the desired perforation locations for the usual self-opening closures of this type. Technically this pre-weakening is rather expensive. One requires costly equipment and the handling for the processing of the perforation locations on the films is time-consuming. In spite of these expensive weakening measures, the usual self-opening closures do not cut clean, but tear the paper or plastic foil before they cut the same clean, which explains the large rotary resistances. Due to the large rotary resistances, even breakages of the transmission media occur now and then, which should take over the transfer of the torque from the threaded cap to the punching sleeve, or the carrier cams that are provided, which engage in the grooves of the punching sleeve, jump out from these grooves. If such a thing happens, the self-opening closure is not capable of functioning any more.

A further problem is that the torn out foil disc or the foil disc cut out halfway by the punching sleeve is tilted downwards too less or the foil disc remains tilted downwards with too little strength over the usage duration, since the punching sleeve is not fixed securely in the end position. All these problems should be solved by a correct self-opening closure.

The solutions known till now are moreover of relatively large size. In the case of a nozzle, this must accommodate a punching sleeve, which must be moved down by some millimeters in order to open the composite laminate, irrespective of whether the sleeve is turned further additionally or not. The transmission medium for the pressing downwards and, if necessary, for the rotating of the sleeve requires lot of space and corresponding size, which is however unfavourable for the stackability of the combipacks equipped with it. Moreover, the individual components are complicated in their design. They are produced separately, namely as nozzles, as screwable cover and as punching sleeve, adjustable in the nozzle. These three parts have to be assembled after the injection molding, which is expensive and, for large quantities, which is the case here, requires particularly cleverly devised and costly automatic assembly machines.

SUMMARY OF THE INVENTION

Therefore, it is pertinent to provide remedies for these problems and create a pouring closure with piercing edge arrangement for combipacks or for containers sealed with foil material, which enables a reliable cutting out of a laminate or foil disc in the thin closure passage, whereby clean cut edges should be achieved, so that projecting shreds are avoided in the passage. For a number of foil materials and composite materials, a targeted pre-weakening of the cutting locations by punching or laser treatment can be even omitted. This pouring closure should have a particularly small size so that the combipacks equipped with it can possibly be stacked better. It should consist of maximum two parts and in a special embodiment be even injection mouldable as a single part, so that a subsequent assembly of several separate parts is omitted.

This problem is solved by a pouring closure with piercing edge arrangement for combipacks or containers sealed with foil material consisting of a flange for the welding on to a combipack or to the foil material of a container sealed with that and a circular rim projecting upwards thereon as well as a twistable combined lid and pouring nozzle that can be clipped on to this rim, which forms a piercing edge arrangement.

BRIEF DESCRIPTION OF THE DRAWING FIGURES

The favorable embodiments of this pouring closure are represented in the figures in different views. This pouring closure and its piercing edge arrangement are described individually and the function of the closure and particularly the function of its piercing edge arrangement is explained and clarified below based on the figures.

Figure 2:
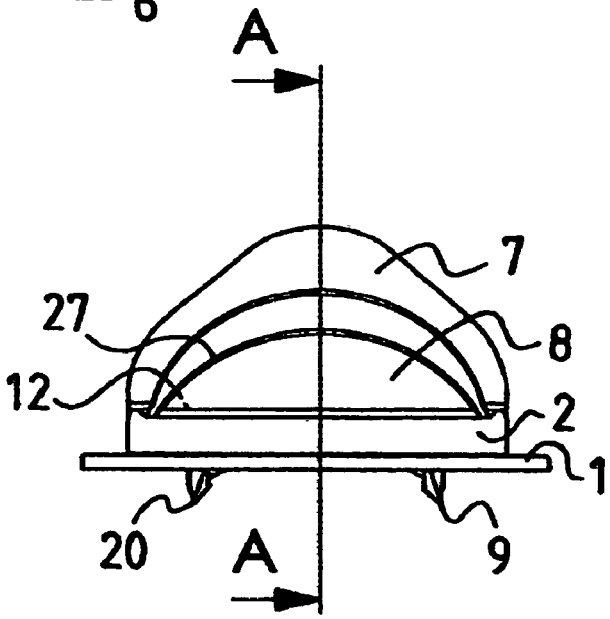
Figure 3:
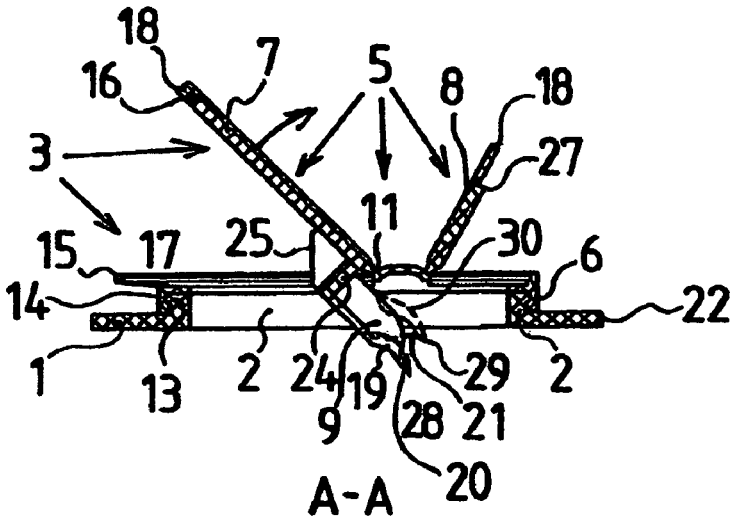
Figure 4:
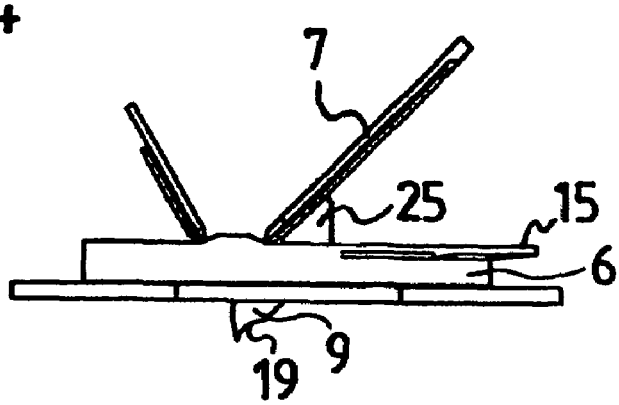
Figure 5:
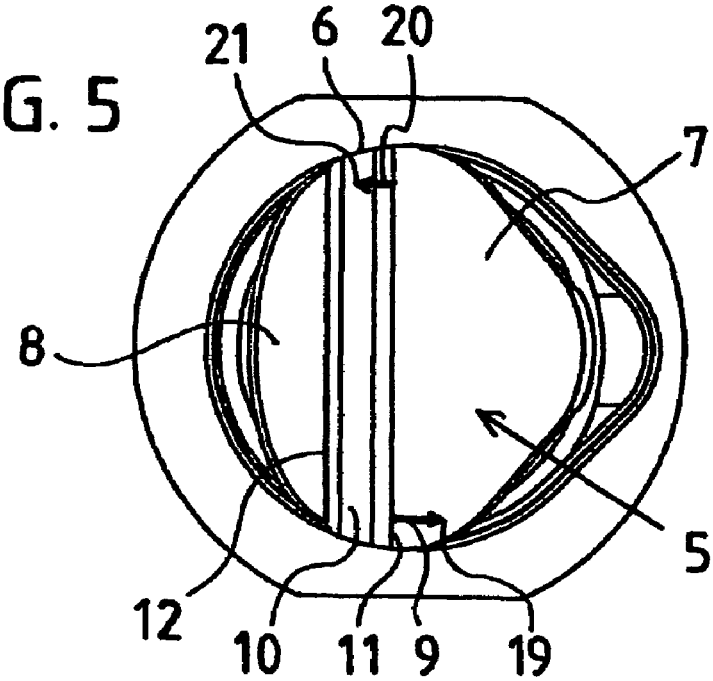
Figure 6:
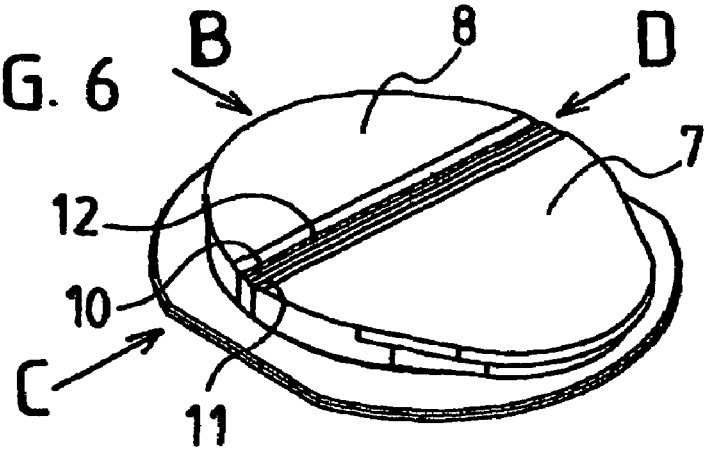
Figure 7:
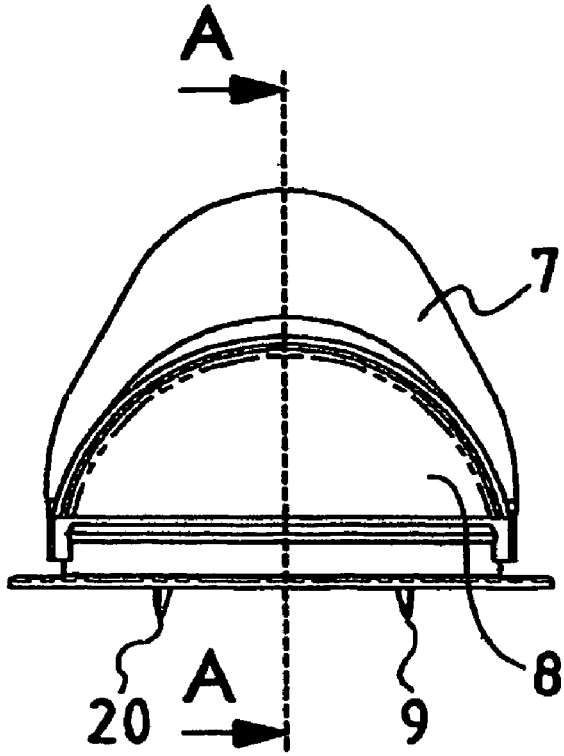
Figure 8:
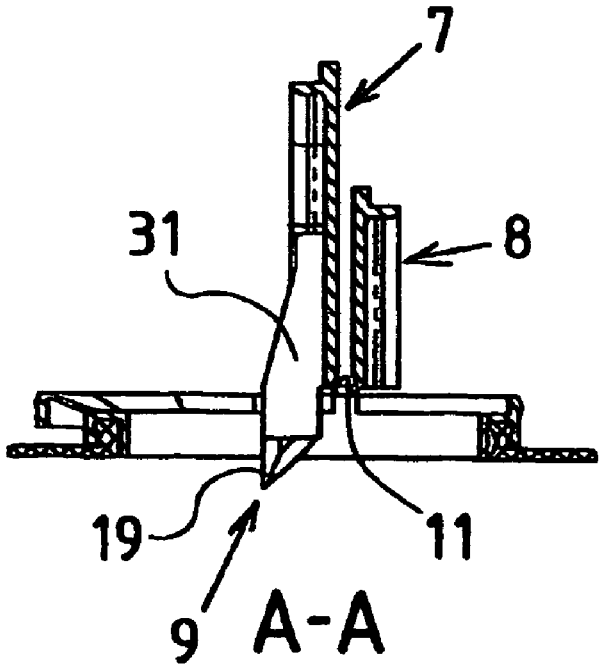
Figure 9:
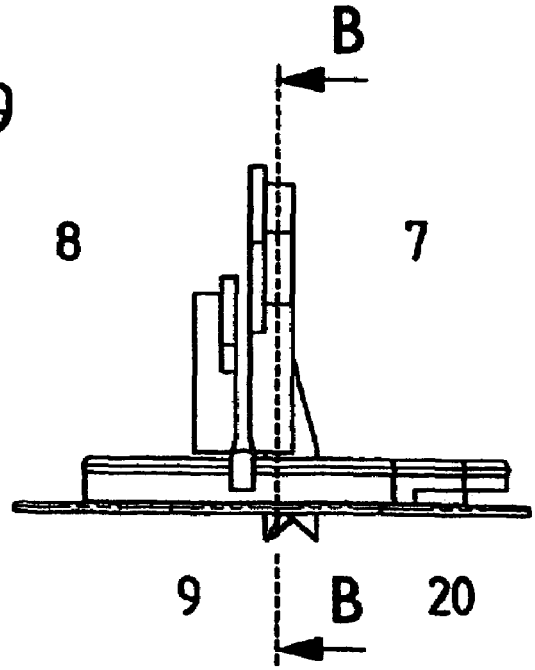
Figure 10:
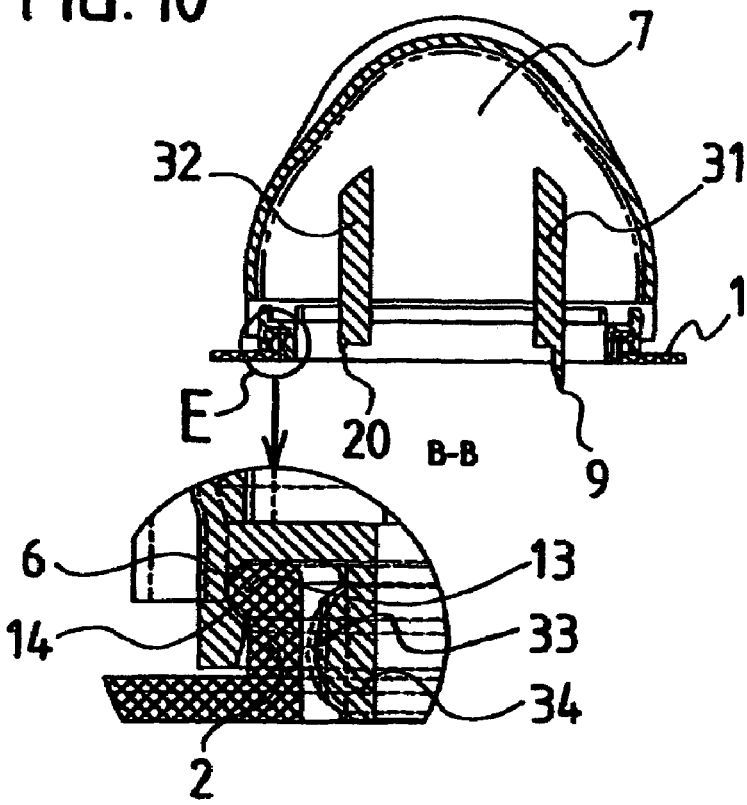
Figure 11:
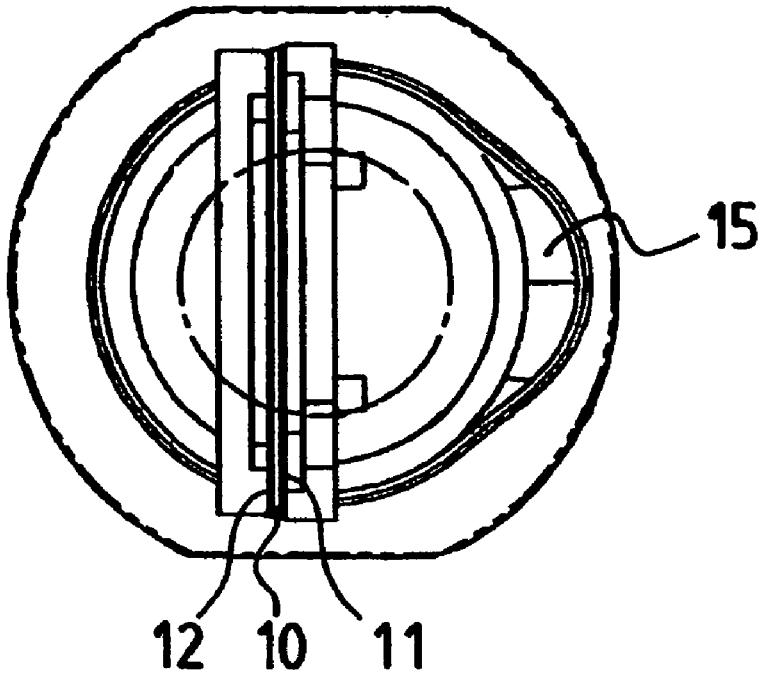
Figure 12:
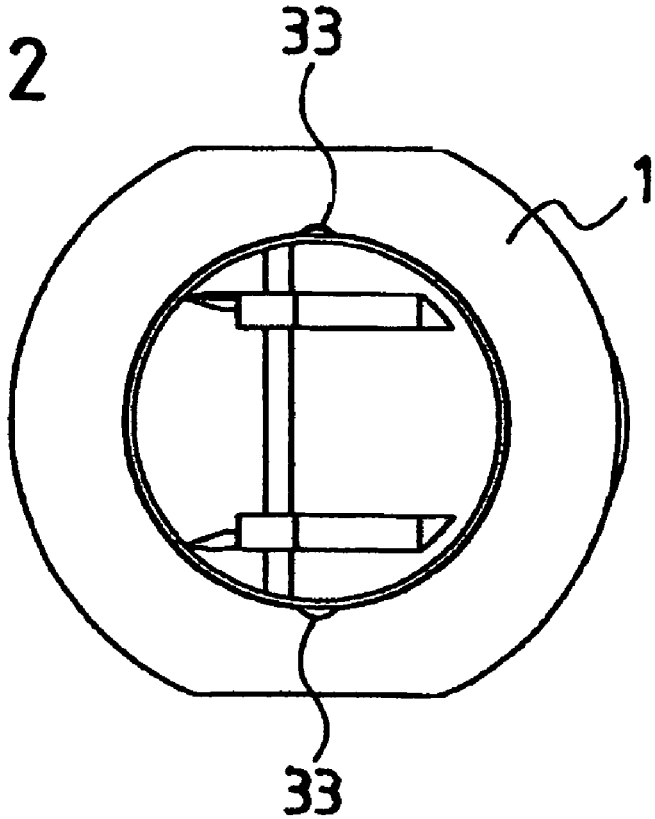

The figures show the following:

FIG. 1: The pouring closure with half-opened lid in a perspective representation;

FIG. 2: This pouring closure with half-opened lid in a view seen from behind in the direction of the arrow B shown in FIG. 1;

FIG. 3: This pouring closure with half-opened lid in a sectional view along the line A-A in FIG. 2 seen from the direction shown with arrow D in FIG. 1;

FIG. 4: This pouring closure with half-opened lid in a side view seen from the direction shown with arrow C in FIG. 1;

FIG. 5: This pouring closure with half-opened lid seen from above;

FIG. 6: A second embodiment variant of such a pouring closure in closed condition seen from above obliquely;

FIG. 7: This second embodiment variant seen from behind in direction of the arrow B in FIG. 6 and with lid parts swung by about 45°;

FIG. 8: This second embodiment variant in a sectional representation along the line A-A in FIG. 7 seen in the direction of the arrow D and FIG. 6;

FIG. 9: This second embodiment variant seen from the side in the direction of the arrow C in FIG. 6; with completely open lid parts;

FIG. 10: This second embodiment variant in a sectional representation along the line B-B seen in FIG. 9 and the enlarged section C of this figure below that;

FIG. 11: This second embodiment variant seen from above with completely open lid parts;

FIG. 12: This second embodiment variant seen from below.

Figure 13:
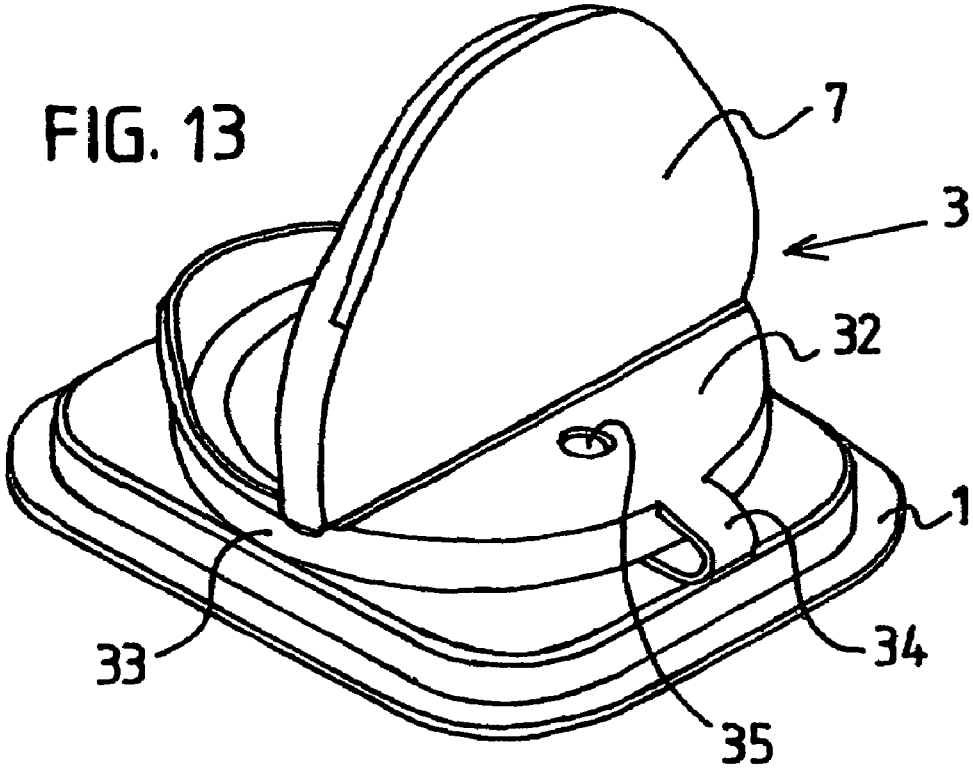
Figure 14:
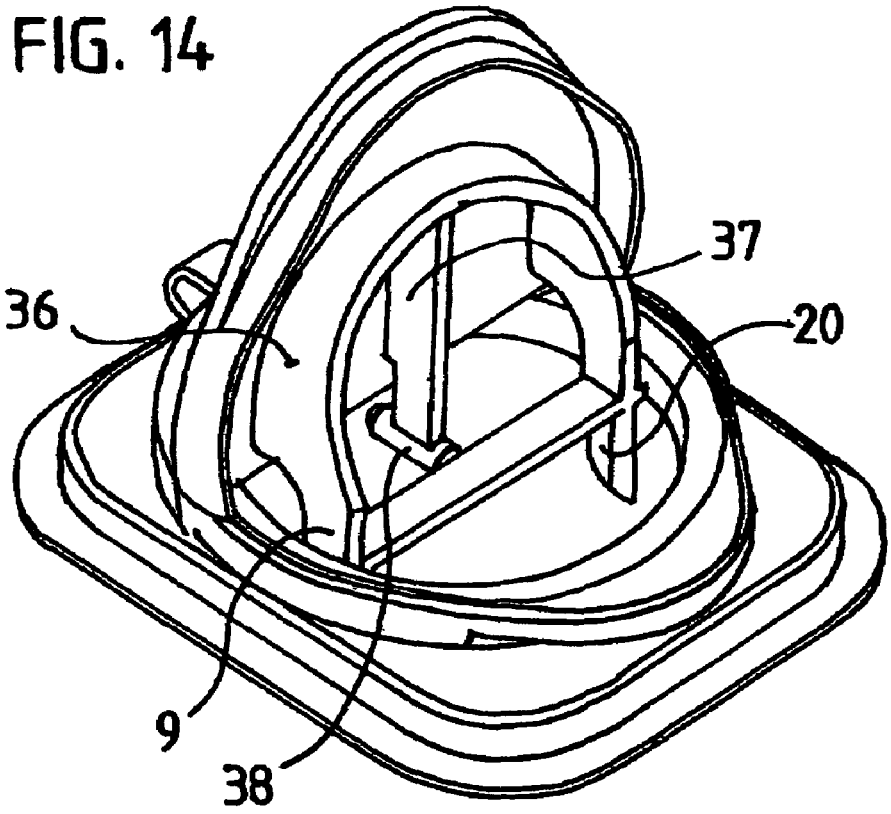

FIG. 13: A third variant of the pouring closure, in which the rear lid part remains closed with front lid part open and seen from behind obliquely;

FIG. 14: This third variant in which the rear lid part remains closed with front lid part open and seen from the front obliquely;

FIG. 15: This third variant with its two injection moulded parts in the condition before the assembly;

FIG. 16: This third variant with the rear lid part clipped on to the lid ring as well as the correlated bottom part of the closure with its flange;

FIG. 17: This third variant of the pouring closure in closed condition seen from below obliquely.

DETAILED DESCRIPTION OF THE DRAWING FIGURES AND PREFERRED EMBODIMENTS

One sees in the FIG. 1 the pouring closure out of injection moulding plastic with half-opened lid in a perspective representation. It consists of a flange 1, which has here a circular external edge 22 over the largest part of its circumference, in which however this edge runs along a secant 23 each in relation to this circle at two sides lying opposite each other. A circular rim 2 formed projecting upwards vertically stands on this flange 1, of which only a part of its inner side can be seen here. A combined lid and pouring nozzle 3 is turned up on this rim 2, which consists of a lid cap 5 and a rim 6 thereon projecting downwards, in which a snap-closing member takes care that it can be clipped on to rim 2 projecting upwards to the flange 1 snapping in so that it is held on it with ability to withstand a pull. The combined lid and pouring nozzle 3 clipped on in this way is however supported on this rim 2 and is twistable along the same flexibly. A pouring lip 15 with sharp tearing edges is formed at the lid and pouring nozzle 3 on its front side. From this lid 3, a part 7 of the lid cap 5 can be swung above an internal hinge 11 running along a secant above this lid cap 5. Adjoining this internal hinge 11, a strap 10 runs above the lid cap 5 and the other edge of the strap 10 is formed by a further internal hinge 12 from which a second part 8 of the lid 3 can be swung above in contra-rotating sense to the part 7. A vertical wall 24 sticking out below is formed beside the internal hinge 11 on the part 7 that can be swung. This wall 24 is propped against the part 7 by means of two wall stays 25, 26. Minimum one piercing cutter is formed on the back side of this wall 24, and hence not visible here, in which the cutting edge of its blade is directed downward for folding up part 7. But preferably, two piercing cutters are provided, one each in the region of each end of the internal hinge 11 on the backside of the wall 24. With regard to its geometry, each of these piercing cutters is so arranged behind the internal hinge 11 to the part 7 and so formed that it is folding up by the swinging of the part 7 and its blade acts downwards with its cutting edge. This will become clearer on the basis of the figures given below and the description. This closure is welded on with the bottom side of its flange 1 to a combipack or the membrane liner of a container sealed with it. The front part 7 that can be folded out forms simultaneously a piercing edge arrangement 4, while the rear part 8 of the lid cap 5 that can be folded out serves on one hand as air inlet for the closure and fitted container and on the other hand for the cutting open of the combipack or membrane liner as will be described in further detail.

The FIG. 2 shows the pouring closure with half-opened covers 7,8 in a view seen from behind, that is, in the direction of the arrow B shown in FIG. 1. This pouring closure is provided with two piercing cutters 9,20, which project downward here for half-opened lid part 7 little above the bottom side of the flange 1. One can recognise a line 27 on the bottom side of the half-folded out rear part 8 of the lid cap, which corresponds to a step 27, which is formed there. On the inner side of the step 27, the part 8 that can be folded out is somewhat thicker than on the outer side, while the upper side of the part 8 is flat as one recognises in FIG. 1. The step 27 can be turned aside fitting exactly in a step matching to that on the upper edge of the projection 2 projecting upwards on the Flange 1. The two steps are so formed that they click into each other by the folding up of the part 8. The region outside the step 27 on the part 8 serves as gripping groove afterwards to which the part 8 can be attached and folded up around the hinge 12. Of the front part 7 on the lid cap 3 that can be folded out, one sees here only the front part of its flat topside. The two piercing cutters 9 and 20 act during the folding up or swinging up of the part 7 at first as piercer, since they are folding up by the folding up movement, and thereby pierce through the combipack or membrane liner running along the bottom side of the flange.

The FIG. 3 shows the pouring closure with half-opened lid parts 7,8 in a sectional view along the line A-A in FIG. 2, and seen from the direction shown with arrow D in FIG. 1. The combined lid and pouring nozzle 3 is reverse drawn on to the flange 1 with its rim 6 projecting downward and its groove 14 on its inner side above the rim 2 projecting upwards and, since this rim 2 has a bulge 13 outside, the groove 14 clicks engaged over the bulge 13 so that the lid and the pouring nozzle 3 is held tightly closed on the rim 2 of the flange 1. One further recognises here how the piercing cutter 9 is formed projecting backward on the wall 24 and what form it has got. It forms in its end region a cutting blade 19 with cutting edge directed downwards. This piercing cutter 9 is not represented here in the section, since it is entirely outside on the other end of the internal hinge 11. The position of the second piercing cutter 20, which would not be really visible here, since it is above the drawing paper plane, was indicated in spite of this in broken line for easy understanding. In contrast to the piercing cutter 9, this second piercing cutter 20 has, in addition to the cutting blade 21 with cutting edge directed towards the front, a cutting blade 30 with cutting edge directed backward or upward. Both piercing cutters 9 and 20 end in a point 28, 29 each. Now, if the part 7, as shown with the crooked arrow, is lifted or folded upwards around the internal hinge 11 in the lid cap 5, the piercing cutter 9, or in the case of two piercing cutters also the piercing cutter 20 lying opposite, is folding upwards by this. Since each piercing cutter 9,20 is essentially shorter than the part 7, it acts as load arm, while the part 7 that can be folded out acts as power arm. Therefore, a considerable compression force can be created through the lifting of the part 7 with the tip 28 of the piercing cutter 9, or in the case of two piercing cutters with their two tips 28, 29, on the combipack or membrane liner running below the flange 1, so that this is pierced reliably. The reaction force, which acts upwards on the internal hinge 11, is collected by the lid cap 3, by which its rim 6 is pulled still more against the rim 2 on the flange 1 and makes the clinging of groove 14 and bulge 13 still stronger.

With further lifting up or folding up, the cutting edge of the cutting blade 19 acts further and cuts the pierced hole further. Thereby, a straight cut results close to the inner edge of the projection 2 projecting upwards on the flange 1 and approximately along this inner edge. In the same way, in case of the presence of a second piercing cutter 20, the cutting edge directed towards the front of its cutting blade 21 cuts the combipack or the membrane liner at the other end of the internal hinge 11 in the same direction. When the two parts 7 and 8 are lifted completely and touch each other, one clasps them between the thumb and index finger of the right hand and thereafter one turns this combined lid and pouring nozzle 3 in the counter clockwise direction seen from above on the projection 2 on the flange 1. This can happen since the entire lid and pouring nozzle 3 has a rim 6 projecting downward, which is provided with a groove 14 on its inner side, with which the lid 3 is clapped on a bulge 13 formed closely fitting to this groove 14 on the outside of the rim projecting upwards on the flange 1. The piercing cutter 9 shown here acts as a knife during the rotating of the lid and pouring nozzle 3. Its blade 19 cuts the combipack along the inner edge of the projection 2. The piercing cutter 20 does the same at the opposite end of the internal hinge 11; only this does not cut with the cutting edge of its blade 21 directed towards the front but with its second cutting edge 30 directed towards the rear. While the piercing cutter 9 visible here moves thus towards the left in the picture for the cutting, the piercing cutter 20 lying opposite in the picture moves at first in the opposite direction, thus would rotate towards the right. Both rotate obviously in the same rotary direction, namely in the counter clockwise direction seen from above. The blades 19 and 21 of the two piercing cutter 9, 20 are arranged geometrically different, namely as follows: The cutting edge of the blade 19 is removed a few millimeter from the vertically folded out part 7 in relation to its horizontal distance from the internal hinge 11, for example about 5 mm further from this, than the cutting edge 30 of the blade 21 of the piercing cutter 20 lying opposite directed backward. That has the effect that, for a rotation of the lid and pouring nozzle 3 by 180°, the blade 19 of the piercing cutter 9 visible here overlaps the beginning of the cut produced by the piercing cutter 20 lying opposite by a few mm. On the other hand, the second piercing cutter 20 does not reach with its cut the beginning of the cut of the first piercing cutter 9 up to this distance difference, hence lets a small composite laminate or membrane liner bridge remain there. But, through the fashioning of the piercing cutter 20, the almost completely cut out composite laminate or membrane liner disc is turned down at the end of the 180°-rotation. In the case of a single piercing cutter, thus for example only the piercing cutter 9 would be present, the lid and pouring nozzle 3 is turned almost or fully 360°. During this rotation, the single piercing cutter 9 cuts out a composite laminate or foil disc along the edge 2 on the flange 1 with the cutting edge of its cutting blade 19, which it turns down afterwards. The packing or container content is thereafter poured out via the pouring lip 15 on the lid and pouring nozzle 3.

The rear part 8 on the lid, which is also open from the lid cap, lets an opening free for the flow of air into the packing or the container so that the outflow cannot begin to bubble due to lack of air flowing in. The two parts 7, 8 are again simply turned down for closing again and, by means of their stepped edges 16, 27, which match shape-wise and with snap action in the correspondingly formed upper edge of the projection on the flange 1, they can be clicked on to be leak-proof. Both the parts 7, 8 that can be open form a region at their front end, which overhangs slightly the projection on the flange 1. A gripping groove 18 each is formed by that by which they can be gripped and opened.

The FIG. 4 shows the pouring closure with half-opened lid in a side view seen from the direction shown with arrow C in FIG. 1. Seen from this side, one sees the first piercing cutter 9 and its cutting blade 19 seen from outside. The wall strut 25, which serves for the stiffening and strengthening of the wall 24, can also be seen, which is formed standing vertical on the lower side of the part 7. The pouring lip 15 projects beyond the rim 6 and has a sharp tear-off edge so that the pouring can be interrupted and resumed again without dripping.

In FIG. 5, finally the pouring closure is represented with half-open parts 7 and 8 seen from above. One can recognise here the strip 10, running between the internal hinges 11 and 12, which connects the two sides of the lid cap 5 or the two rim sections 6 projecting downwards there. The two piercing cutters 9, 20 are represented schematically as arrows and their blades 19, 21 indicated, in which the arrow tips mark the position of the cutting edges for part 7 open fully. One can recognise that the cutting edge of the blade 19 directed towards the front lies further removed from the internal hinge 11 than the cutting edge 30 of the blade 21 of the second piercing cutter 20 directed backward. Therefore, a short piece of laminate or foil is left remaining for a 180°-rotation of the lid and pouring nozzle 3 by which the disc, cut out clean otherwise, can be turned down afterwards.

The FIG. 6 shows a second embodiment variant of such a pouring closure and the FIG. 7 shows the same seen from behind in the direction of the arrow B in FIG. 6 and with lid parts 7, 8 open by about 45°. One can again recognize in FIG. 7 the two piercing cutters 9, 20, from which a cutting edge shows on both sides marked here in left, that is, one directed towards the front and one directed backward. The FIG. 8 shows the difference to the variant according to the FIGS. 1 to 5 described first. Namely, here the piercing cutter 9—one sees the closure here in relation to the FIG. 7 from left—is formed by a rib 31, which is formed at the bottom side of the lid 7 and extended backward beyond the internal hinge 11. The cutting edge 19 moves at first towards left during the rotation of the lid in the counter clockwise direction seen from above in the diagram.

The FIG. 9 shows this second embodiment variant seen from the side in the direction of the arrow C in FIG. 6 with lid parts 7, 8 fully open. In this condition, the two piercing cutters 9, 20 are slightly staggered from each other in relation to the circumference of the lid. Therefore, one sees in the sectional drawing, which shows the closure in a section along the line B-B in FIG. 9, only the piercing cutter 9 and even this only for about half, while only a small extension of the other piercing cutter can be seen due to its displacement to the piercing cutter 9. The enlarged section E shows how the lid is held on the projection 2 of the flange 1 with its rim 6. A circular groove 14 is present on the inner side, in which a bulge 13 on the outer side of the projection 2 is fitted. An additional collar 34 projecting downward is formed on the lid bottom side and this collar 34 has a protuberance 33 here. As one can recognizes from the FIG. 12, which shows the closure in a view from below, two such protuberances 33 are formed on the collar 34 on sides lying opposite each other. They prevent the lid from jumping from the projection 2 during the lifting of the lid part 7 and piercing of the membrane liner.

In FIG. 13, a third variant of the pouring closure is shown. In this variant, as a special feature, the rear lid part remains closed also in the usage condition, that is, for opened closure. Here, the lid 3 consists of the actual lid cap 32 as well as a correlated lid ring 33, which two are connected with each other via a band 34, so that they can be injection moulded in one piece in one process. The rear lid part has a hole 35, which is open in the opened condition of the closure, thus with open front lid part 7, and serves as air inlet. In FIG. 14, this third variant of the closure is represented with open front lid part 7 and seen from the front obliquely. A curved, totally U-shaped rib 36 is formed on the bottom side of the lifted front lid part 7, in which the ends of the shank of the formed U form the two piercing cutter 9, 20. A further rib 37 is formed in the middle within this U-shaped rib 36, which carries a bolt-type plug 38 at its rear or bottom end. This plug 38 is folded up during the closing of the lid part 7 and enters from below into the hole 35 in the rear lid part and sealing it. The FIG. 15 shows this third variant of the closure with its two injection molded parts in the condition before the assembly. The entire closure thus consists of two single injection moulded parts, namely the bottom part with flange 1 as well as the lid 3 consisting of lid ring 33 and a lid cap formed on that via the connection band 34. Engaging elements 39 are formed below on the rear part of the lid cap, which fit into corresponding engaging holes 40 in the lid ring 33 and engage there in a leak-proof condition when the lid cap is fixed on the lid ring 33. These have an axle pin 41 each on the outer side of piercing cutter 9, 20. Axle bearings 42 are formed on the bottom side of the lid ring 33 suiting them and bulges 43 are present on the lid lower part for receiving the axle pins 41.

The FIG. 16 shows the lid 3 in assembled condition and below that the closure bottom part. The two piercing cutters 9, 20 are pressed somewhat against each other during the fixing of the lid cap on the lid ring 33 and guided through the lid ring 33, whereupon they come to rest in the axle bearings 42 on the lower edge of the lid ring 42. Then, the lid ring is clipped on the closure bottom part so that the bulge 13 on the outer side of the projection on the bottom part engages in the circular groove 14 on the inner side of the lid ring 33.

The FIG. 17 shows the fully assembled pouring closure according to these three variants seen from below obliquely. The bolt-type plug 38 was folded up from below into the hole 35 in the rear part by the folding up of the front lid part 7 which closed this hole 35 airtight. Now, if the front lid part 7 is folded up, the two piercing cutters 9, 20 will swing down and pierce the foil, on which the closure is welded or stuck with the bottom side of the flange 1. Thereafter, the lid 3 can be turned together with its lid ring 33 so that the piercing cutters 9, 20 now act as knives and cut the membrane liner along the lid ring circumference.

The invention claimed is:

1. A pouring out closure with a piercing edge arrangement for combipacks or containers sealed with a foil material, comprising:

a flange for welding onto a combipack or to a foil material of a container sealed with the foil material; and, a combined lid and pouring nozzle rotatable horizontally on said flange, said flange having a projecting rim projecting upwardly and being circular, said projecting rim of said flange including means for clipping said combined lid and pouring nozzle onto said projecting rim, so that said combined lid and pouring nozzle is held on said projecting rim, but rotatable around an axis of said projecting rim, for forming the piercing edge arrangement, wherein said combined lid and pouring nozzle form a lid cap having a downwardly projecting rim that is clippable onto said projecting rim projecting upwardly on said flange with one part of said lid cap being openable from a lid surface around a swinging axis, so that at least one piercing cutter is formed on a lower side of said one part of said lip cap behind the swinging axis near an edge of said downwardly projecting rim with a piercing edge blade and a cutting edge projecting downward and foldable upwardly beyond a level of a bottom side of said flange and is further movable in a swung position via rotating said lid cap on said downwardly projecting rim along said projecting rim projecting upwardly.

2. The pouring out closure with a piercing edge arrangement for combipacks or containers sealed with a foil material according to claim 1, wherein behind said one part of said cap lid, said one part being a first part, there is a second part of said cap lid that is openable in a contra-rotating swinging direction around a parallel swinging axis displaced from the swinging axis of said first part of said cap lid.

3. The pouring out closure with a piercing edge arrangement for combipacks or containers sealed with a foil material according to claim 2, wherein said first part and said second part of said cap lid lying opposite one another are openable from a lid surface against each other, so that said cap lid forms a strap along a secant on whose two edges said first part and said second part that are openable.

4. The pouring out closure with a piercing edge arrangement for combipacks or containers sealed with a foil material according to claim 1, wherein a lid of said combined lid and pouring nozzle comprises a lid cap and a single-piece lid ring hanging on said lip cap via a band via engaging means.

5. The pouring out closure with a piercing edge arrangement for combipacks or containers sealed with a foil material according to claim 1, wherein said combined lid and pouring nozzle is clippable on said projecting rim forms a lid cap having a downwardly projecting rim that is clippable onto said projecting rim projecting upwardly and being circular on said flange, wherein said projecting rim projecting upwardly and being circular has a bulge along its outer side running around its circumference with said lip cap having a groove matching said bulge on an inner side of said downwardly projecting rim.

6. The pouring out closure with a piercing edge arrangement for combipacks or containers sealed with a foil material according to claim 1, wherein said combined lid and pouring nozzle that is clippable onto said projecting rim projecting upwardly and being circular forms a pouring lip projecting radially from said projecting rim.

7. The pouring out closure with a piercing edge arrangement for combipacks or containers sealed with a foil material according to claim 1, wherein said combined lid and pouring nozzle that is clippable onto said projecting rim projecting upwardly forms a cap lid having a downwardly projecting rim that is clippable onto said projecting rim projecting upwardly on said flange, said cap lid having one part that is openable from a lid surface, and that an outer lower rim of said first part forms a step, that fits with a complementary step on an upper rim of said projecting rim projecting upwardly on said flange, wherein a gripping groove is formed on a front side of, at least, said one part of said cap lid that overlaps said upper rim on its outer side projecting downwardly in a folding-up condition.

8. A pouring out closure with a piercing edge arrangement for combipacks or containers sealed with a foil material, comprising:

a flange for welding onto a combipack or to a foil material of a container sealed with the foil material; and, a combined lid and pouring nozzle rotatable horizontally on said flange, said flange having a projecting rim projecting upwardly and being circular, said projecting rim of said flange including means for clipping said combined lid and pouring nozzle onto said projecting rim, so that said combined lid and pouring nozzle is held on said projecting rim, but rotatable around an axis of said projecting rim, for forming the piercing edge arrangement, wherein said combined lid and pouring nozzle form a cap lid having a downwardly projecting rim that is clippable on said projecting rim projecting upwardly on said flange and rotatable thereon, with at least one part of said cap lid being openable from a lid surface around a swinging axis, so that two piercing cutters are formed on a lower side of said one part of said cap lid being its swinging axis near an edge of said downwardly projecting rim of said cap lid with piercing edge blades being foldable beyond a level of a bottom side of said flange and movable in a swung position via rotating said cap lid on said downwardly projecting rim along said projecting rim projecting upwardly.

9. The pouring out closure with a piercing edge arrangement for combipacks or containers sealed with a foil material according to claim 8, wherein said two piercing cutters having said piercing edge blades formed on a lower side of said one part of said cap lid are openable so that, for said one part to open vertically to an upper side of said cap lid, a cutting edge of a first piercing edge blade of said two piercing edge blades develops a cutting action in a direction to a front side of said pouring out closure for a rotation of said lip cap in a counter-clockwise direction, thereby lying further removed from the swinging axis than a second piercing edge blade of said piercing edge blades directed backwards of said piercing edge blade of one piercing cutter of said two piercing cutting arranged oppositely thereto, thereby developing a cutting action, initially, in a direction to a rear side of said pouring out closure.

10. The pouring out closure with a piercing edge arrangement for combipacks or containers sealed with a foil material according to claim 8, wherein a lid of said combined lid and pouring nozzle comprises a lid cap and a single-piece lid ring hanging on said lip cap via a band via engaging means.

11. The pouring out closure with a piercing edge arrangement for combipacks or containers sealed with a foil material according to claim 8, wherein said combined lid and pouring nozzle is clippable on said projecting rim forms a lid cap having a downwardly projecting rim that is clippable onto said projecting rim projecting upwardly and being circular on said flange, wherein said projecting rim projecting upwardly and being circular has a bulge along its outer side running around its circumference with said lip cap having a groove matching said bulge on an inner side of said downwardly projecting rim.

12. The pouring out closure with a piercing edge arrangement for combipacks or containers sealed with a foil material according to claim 8, wherein said combined lid and pouring nozzle that is clippable onto said projecting rim projecting upwardly and being circular forms a pouring lip projecting radially from said projecting rim.

13. The pouring out closure with a piercing edge arrangement for combipacks or containers sealed with a foil material according to claim 8, wherein said combined lid and pouring nozzle that is clippable onto said projecting rim projecting upwardly forms a cap lid having a downwardly projecting rim that is clippable onto said projecting rim projecting upwardly on said flange, said cap lid having one part that is openable from a lid surface, and that an outer lower rim of said first part forms a step, that fits with a complementary step on an upper rim of said projecting rim projecting upwardly on said flange, wherein a gripping groove is formed on a front side of, at least, said one part of said cap lid that overlaps said upper rim on its outer side projecting downwardly in a folding-up condition.

* * * * *